United States Patent [19]

Matsumoto

[11] Patent Number: 4,840,159

[45] Date of Patent: Jun. 20, 1989

[54] APPARATUS FROM CONTROLLING AMOUNT OF INTAKE AIR TO ENGINE

[75] Inventor: Osamu Matsumoto, Hyogo, Japan

[73] Assignee: Mitsubishi Denki Kabushiki Kaisha, Tokyo, Japan

[21] Appl. No.: 161,051

[22] Filed: Feb. 26, 1988

[30] Foreign Application Priority Data

Feb. 26, 1987 [JP] Japan ..... 62-29303
Feb. 26, 1987 [JP] Japan ..... 62-29304

[51] Int. Cl.[4] ..... F02M 23/00
[52] U.S. Cl. ..... 123/585
[58] Field of Search ..... 123/339, 585

[56] References Cited

U.S. PATENT DOCUMENTS 2,943,615 7/1960 Kainz ..... 123/339
4,378,767 4/1983 Kobashi et al. ..... 123/339
4,388,913 6/1983 Grimm et al. ..... 123/339
4,712,531 12/1987 Ishizawa et al. ..... 123/585

FOREIGN PATENT DOCUMENTS 59-5856 1/1984 Japan .
59-18124 5/1984 Japan .
62-13749 1/1987 Japan ..... 123/339
802463 10/1958 United Kingdom ..... 123/339

*Primary Examiner*—Andrew M. Dolinar
*Attorney, Agent, or Firm*—Sughrue, Mion, Zinn, Macpeak & Seas

[57] ABSTRACT

An apparatus for controlling the amount of intake air to an engine comprises a throttle body, a throttle valve disposed in the body, a bypass passage that bypasses the throttle valve. The throttle body forms a part of the air intake passage for the engine. In one embodiment of the invention, a guide passage is formed in the throttle body and extends upwardly from the bypass passage. The open end of the guide passage is disposed above the center line of the inside of the throttle body. In another embodiment of the invention, a barrier such as a protrusion or groove is formed in the inner surface of the throttle body and disposed above the open end of the bypass passage to prevent fuel, oil, and other substances from flowing into the bypass passage.

4 Claims, 3 Drawing Sheets

APPARATUS FROM CONTROLLING AMOUNT OF INTAKE AIR TO ENGINE

BACKGROUND OF THE INVENTION

The present invention relates to an apparatus for controlling the amount of intake air to an engine and, more particularly, to an apparatus equipped with a structure in which a controlled amount of auxiliary air is supplied so as to bypass the throttle valve.

In a known structure as disclosed in Japanese Utility Model Publication No. 18124/1984 or Japanese Patent Laid-Open No. 5856/1984, a throttle valve is installed in an intake passage to control the amount of intake air to an engine, and a bypass passage that bypasses the throttle valve has a bypass control valve. The output power of the engine can be varied at will by arbitrarily controlling the amount of intake air to the engine by the use of the throttle valve. When the engine is warmed up, the bypass control valve is controlled according to various engine parameters, such as the temperature of the engine coolant and the engine speed under unloaded condition, to achieve desired objects.

Various devices are installed in an engine compartment to enhance the performance of the engine and, therefore, large space is not left in the compartment. The bypass passage structure including the bypass control valve is detachably mounted to a throttle body which includes the throttle valve and forms the intake passage. The bypass passage structure and the throttle body form a compact unit. Of course, limitations are imposed on the arrangement of the various devices in the engine compartment.

Under these conditions, the throttle body is disposed horizontally, i.e., the intake passage extends horizontally. Also, the valve shaft of the throttle valve perpendicular to the intake passage is disposed horizontally. The bypass passage structure including the bypass control valve is mounted either above or below the throttle body. In case that the structure is disposed below the throttle body, the spatial arrangement is more advantageous than the case where it is disposed above the throttle body. In the former case, the bypass passage that bypasses the throttle valve in the intake passage normally extends vertically downward through the throttle body and opens at the bottom of the throttle body.

Fuel contained in the gas discharged from the engine, fuel contained in the circulating blowby gas, and moisture, carbon, oil mist, and other substances produced by combustion (hereinafter referred to as liquid adhesives) adhere to the inner surface of the throttle body. Especially, when the engine is not in operation, these adhering substances flow down the wall surface by the action of gravity and are collected in the lower part of the cylindrical wall surface. Then, they pass through the vertically extending bypass passage which opens at the bottom of the throttle body, and flow into the valve portion that controls the bypass passage. Eventually, they are deposited and caked on the metering portion of the valve seat and also on the sliding portion of the valve body. As a result, a metering error occurs and smooth operation of the valve body is impeded, so that the accuracy in controlling the amount of auxiliary air is deteriorated.

SUMMARY OF THE INVENTION

The present invention is intended to eliminate the foregoing problems with the prior art techniques. It is an object of the invention to provide an apparatus which controls the amount of intake air to an engine without causing any breakdown of the bypass system and without deteriorating the accuracy after the apparatus is used for a long time.

An intake air amount control apparatus according to the invention comprises a throttle body, a guide passage formed in the throttle body, and a bypass passage disposed below the throttle body and connected with the guide passage, wherein at least one open end of the guide passage is disposed above the center line of an intake passage and in the inside of the throttle body.

Another control apparatus according to the invention comprises a throttle body, a throttle valve disposed in the throttle body, a bypass passage which bypasses the throttle valve and has an open end provided in the lower portion of the throttle body, and a second valve for controlling the amount of air flowing through the bypass passage, wherein a barrier such as a protrusion, groove, or rib, is formed in the inner surface of the throttle body and disposed above the open end of the bypass passage.

In accordance with the present invention, the open end of the bypass passage is formed in the inner wall of the throttle body and disposed above the center line of the intake passage, or the barrier is formed in the inner surface of the throttle body and disposed above the open end of the bypass passage. Therefore, liquid adhesives do not flow into the open end. When the engine is started next, the liquid adhesives staying either in the lower portion of the intake passage or around the barrier are absorbed into the engine by large suctional air flow and disappear.

DETAILED DESCRIPTION OF THE PREFERRED EMBODIMENTS

Figure 1:
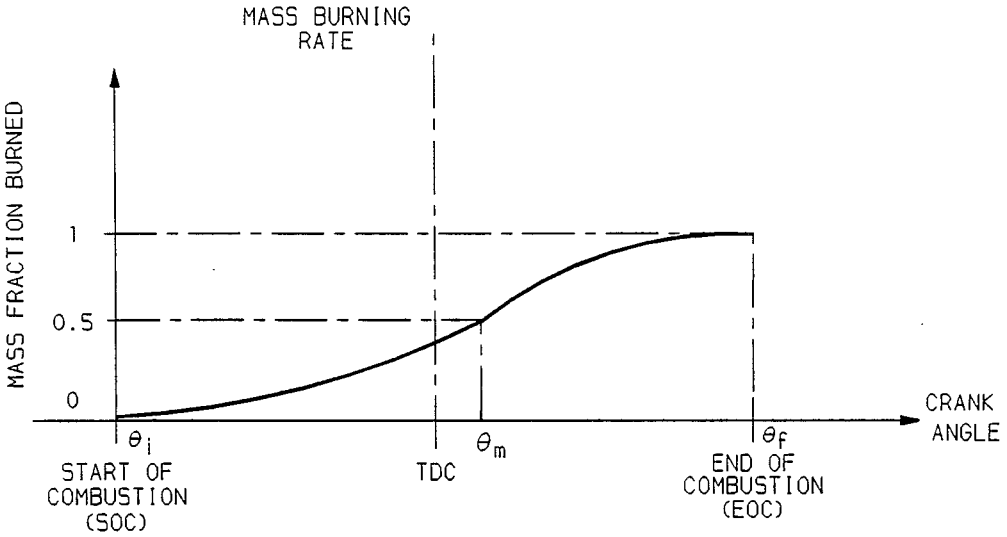
FIG. 1 is a cross-sectional view of an apparatus according to the invention.
Figure 2:
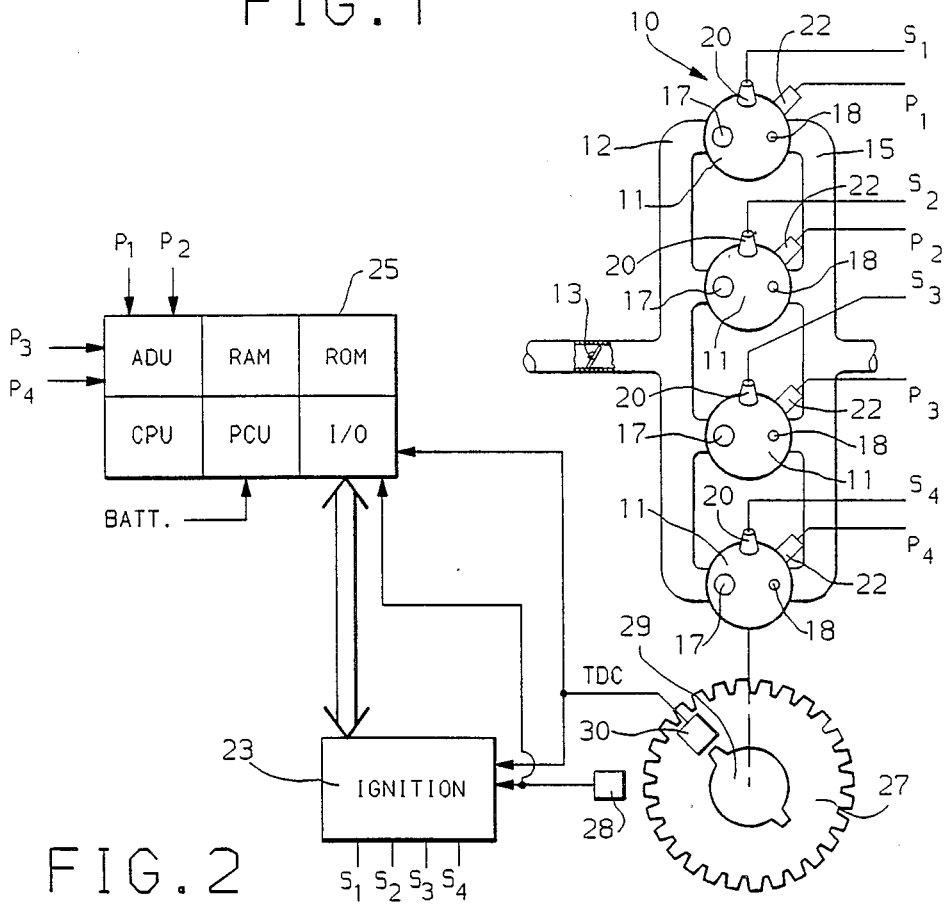
FIG. 2 is a cross-sectional view taken along line II—II of FIG. 1.
Figure 3:
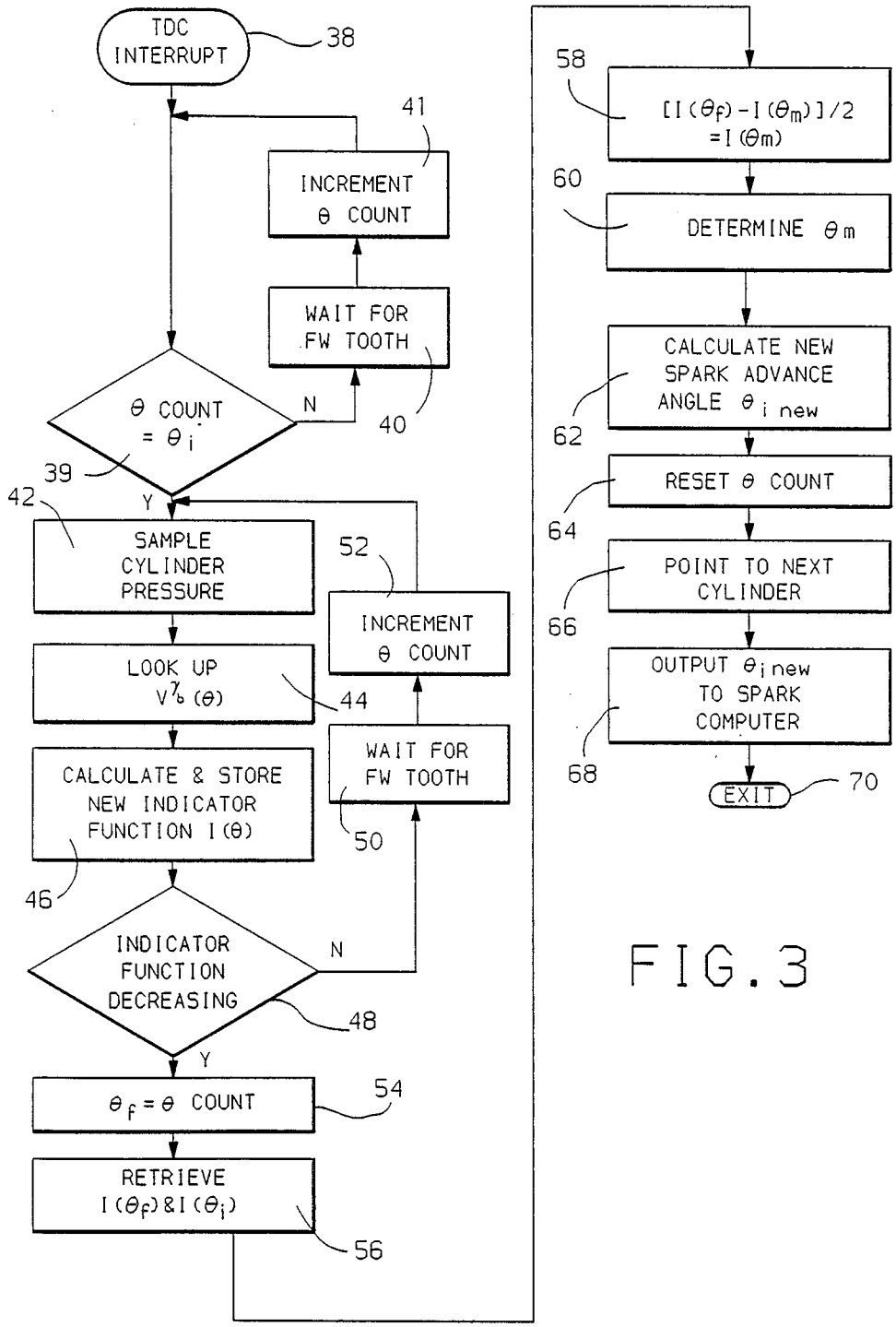
FIG. 3 is a cross-sectional view taken along line III—III of FIG. 1.
Figure 1:
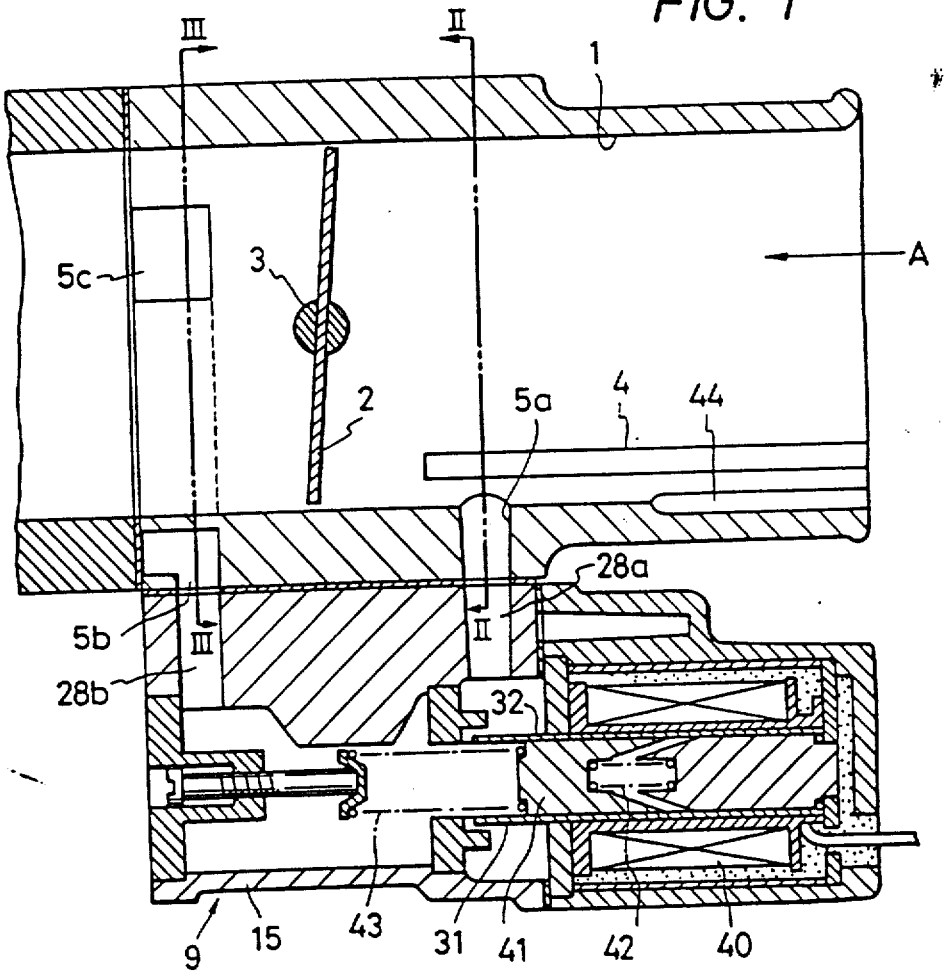
Figure 2:
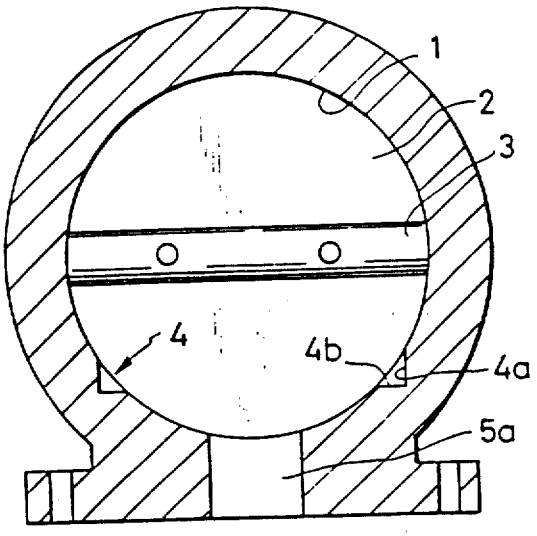
Figure 3:
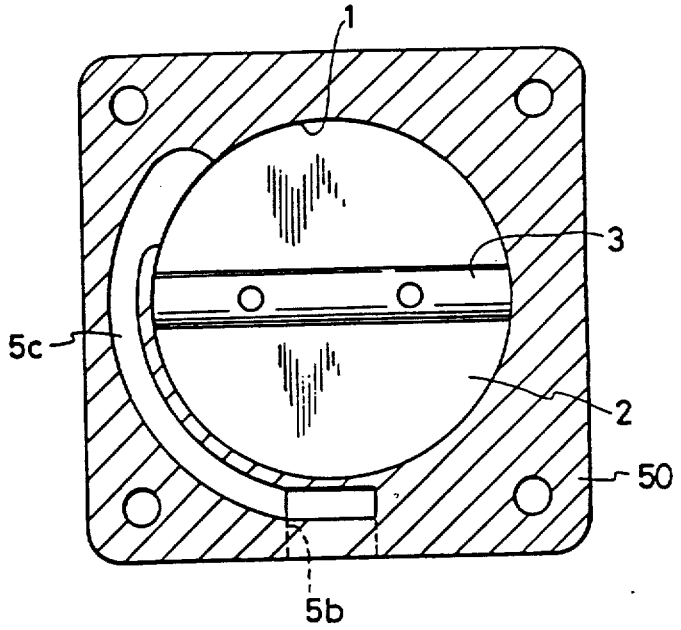

Referring to FIGS. 1–3, an embodiment of the present invention will be described. The apparatus has a throttle body extending horizontally and forming an intake passage, the inside of which is indicated by numeral 1. A throttle valve 2 is mounted in the throttle body. A valve shaft 3 is disposed horizontally and at the right angle to the axis of the intake passage. Barriers 4 are formed in the intake passage. Bypass passages **5*a* and 5*b* extend vertically downward from the bottom of the inside of the throttle body. The bypass passage 5*b* opens into the intake passage at a location above the center line of the intake passage through a guide passage 5*c* extending from the bypass passage 5*b*. The bypass passage 5*a* directly opens into the intake passage. A flange 50 is used to mount the throttle body to an engine. The aforementioned guide passage 5*c* is formed in this flange 50 in the form of a channel. The guide passage 5*c*** cooperates with a flange (not shown) on the engine side to form a passage like a tunnel.

The amount of air flowing through the intake passage in the inside 1 of the throttle body toward the engine in the direction indicated by the arrow A is arbitrarily controlled by the use of the throttle valve 2. Then, fuel injection nozzles (not shown) provided on intake manifolds (not shown) of the engine inject fuel according to the amount of air. As a result, an air-fuel mixture enters the engine. When no load is imposed on the engine, the throttle valve 2 assumes the illustrated position. Under this condition, the amount of auxiliary air flowing through the bypass passages 5*a* and 5*b* is controlled to maintain the engine speed at a constant value suitable for the temperature of the engine coolant.

For this purpose, the apparatus is equipped with a proportional solenoid valve 9 having a valve housing 15. This housing 15 has an air inlet port 28*a* and an air exit port 28*b* which are in communication with the bypass passages 5*a* and 5*b*, respectively. Auxiliary air flows from the air inlet port 28*a* to the air exit port 28*b* through a valve hole 31 formed in a cylinder 32. A valve body 41 consisting of a movable iron core is disposed in the cylinder 32 to control the open area of the hole 31. The core is mounted between springs 42 and 43 and controlled according to the electric current flowing through a solenoid coil 40.

An electronic control circuit (not shown) compares the engine speed actually measured with an intended engine speed and produces a signal corresponding to the difference (see Japanese Utility Model Publication No. 18124/1984). The solenoid coil 40 is energized with this signal to control the position of the valve body 41 in proportion to the current value of the signal. Thus, the open area of the hole 31 is controlled to a value corresponding to the position of the valve body 41. As a result, the amount of air flowing through the bypass passages 5*a* and 5*b* are controlled so that the engine speed becomes equal to the intended speed. Of course, fuel is injected from the fuel injection nozzles according to the amount of air and enters the engine together with air.

During the operation of the engine, the air-fuel mixture flows at a large flow rate in the direction indicated by the arrow A so that the liquid adhesives to the inner surface 1 of the throttle body pose no problems. However, when the engine is at rest, the liquid adhesives contained in the gas discharged from the engine and in the circulating blowby gas adhere to the inner surface 1 of the throttle body and move down by the action of gravity. However, the liquid adhesives hardly flow into the guide passage 5*c*, because this guide passage 5*c* opens into the intake passage at a location close to the top of the inner surface 1 of the throttle body. Hence, the liquid adhesives do not flow through the bypass passage 5*b*.

The liquid adhesives moving down toward the bypass passage 5*a* encounter the barriers 4, each taking the form of a groove defined by a vertical wall 4*a* and a horizontal wall 4*b*. Then, they spread horizontally along the horizontal walls 4*b*. Therefore, they do not directly flow into the bypass passage 5*a*. When the engine is started next and the amount of intake air increases, the intake air blow off the liquid adhesives remaining on the horizontal walls 4*b*. The liquid adhesives remaining on the lower portion of the inner surface 1 of the throttle body are forced out of recesses 44 and atomized by the large amount of intake air, so that they disappear.

In the illustrated example, the bypass passage 5*b* extends from the guide passage 5*c* formed in the flange 50. A similar guide passage extending from the bypass passage 5*a* may be formed instead of the barriers 4.

Figure 4:
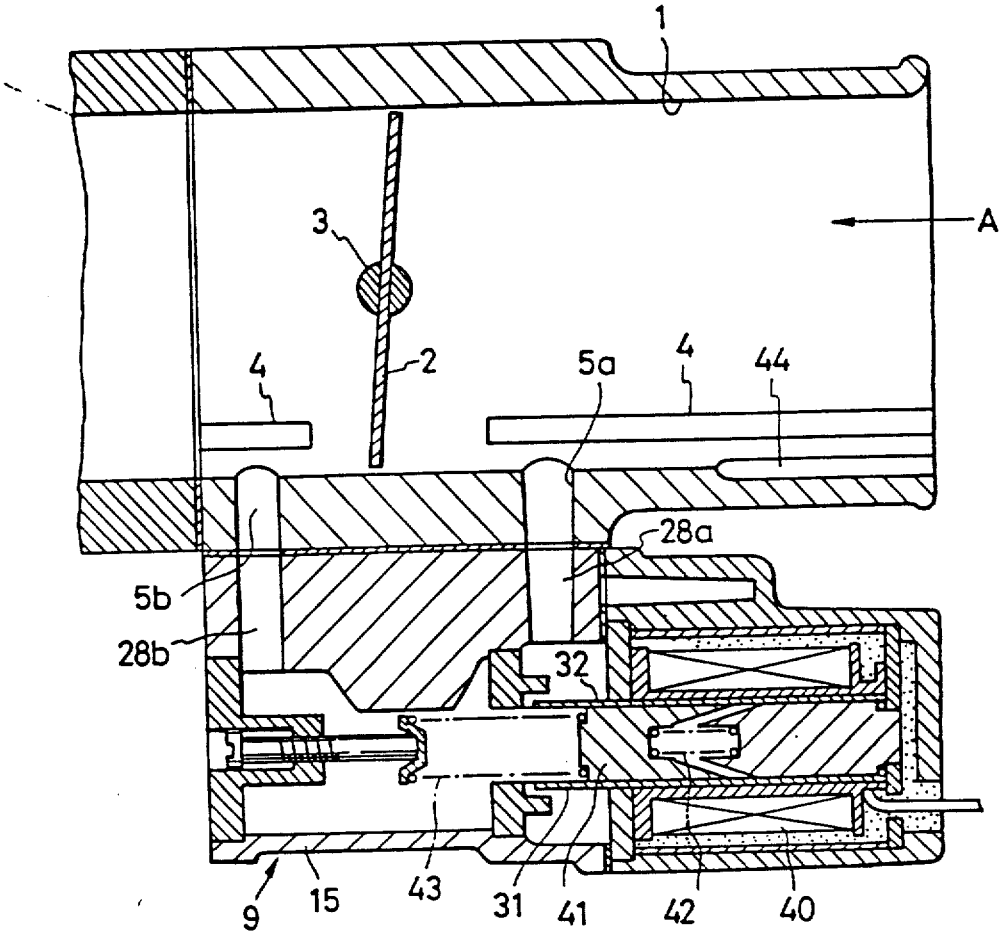
FIG. 4 is a cross-sectional view of another apparatus according to the invention.

Referring next to FIG. 4, there is shown another apparatus according to the invention. This apparatus is similar to the apparatus shown in FIGS. 1–3 except that barriers 4 are formed in front of the bypass passage 5*b* instead of the guide passage 5*c*.

Figure 5:
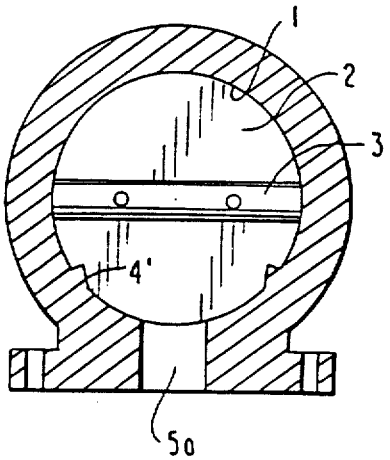
FIG. 5 is a cross-sectional view of apparatus according to yet another embodiment of the present invention.

In the illustrated examples, the horizontal walls 4*b* of the barriers 4 extend literally horizontally. The horizontal walls 4*b* may be inclined downwardly to the right from the bypass passage 5*a* and inclined downwardly to the left from the bypass passage 5*b*. If casting technique allows, an annular barrier such as a protrusion or rib may be formed around each of he bypass passages 5*a* and 5*b* as shown by the rib 4' of FIG. 5.

In the above examples, the bypass passages include the proportional solenoid valve 9. This valve may be replaced by a temperature-responsive valve which operates by thermowax or the like. In this case, of course, similar advantages can be obtained.

As described above, in the novel apparatus of the present invention, barriers are formed on the inner surface of the throttle body above the bypass passage, or a guide passage extends from the bypass passage and is disposed near the top of the inner surface of the throttle body. Therefore, liquid adhesives which were contained in the gas discharged from the engine and in the circulating blowby gas do not flow into the bypass passage. As a result, the accuracy in the controlled amount of auxiliary air does not deteriorate and the control mechanisms do not cease to operate, even if the apparatus is used for a long period.

What is claimed is:

1. An apparatus for controlling the amount of intake air to an engine, comprising:

a throttle body forming a part of an air intake passage for said engine, said throttle body being oriented so that the inside of said throttle body defines a horizontal passage;

a throttle valve disposed in said throttle body;

a second valve coupled to the bottom of said throttle body and acting to control the amount of auxiliary air flowing through a bypass passage which bypasses said throttle valve; and at least one guide passage formed in said throttle body and connected with said bypass passage, said guide passage having an open end in said horizontal passage disposed above the center line of said horizontal passage.

2. An apparatus for controlling the amount of intake air to an engine, comprising:

a throttle body forming a part of an air intake passage for said engine;

a throttle valve disposed in said throttle body;

a bypass passage which bypasses said throttle valve and supplies auxiliary air, at least one open end of said bypass passage being located at the bottom of said throttle body, and disposed upstream relative to the flow of said air from said throttle valve;

a second valve for controlling the amount of auxiliary air flowing through said bypass passage; and at least one barrier formed on the inner surface of said throttle body and disposed above said open end of said bypass passage to prevent fuel, oil, and other substances adhering to the inner surface of said throttle body from flowing into said bypass passage.

3. An apparatus as claimed in claim 2, wherein said barrier is a protrusion surrounding said open end.

4. An apparatus for controlling the amount of intake air to an engine, comprising:

a throttle body forming a part of an air intake passage for said engine;

a throttle valve disposed in said throttle body;

a bypass passage which bypasses said throttle valve and supplies auxiliary air, at least one open end of the bypass passage being located at the bottom of said throttle body;

a second valve for controlling the amount of auxiliary air flowing through said bypass passage; and at least one barrier formed on the inner surface of said throttle body and disposed above said open end of said bypass passage to prevent fuel, oil, and other substances adhering to the inner surface of said throttle body from flowing into said bypass passage, wherein said barrier is a groove consisting of a horizontal wall and a vertical wall.

* * * * *

UNITED STATES PATENT AND TRADEMARK OFFICE

CERTIFICATE OF CORRECTION

PATENT NO. : 4,840,159

DATED : June 20, 1989

INVENTOR(S) : Osamu Matsumoto

It is certified that error appears in the above-identified patent and that said Letters Patent is hereby corrected as shown below:

Please change the title from "APPARATUS FROM CONTROLLING AMOUNT OF INTAKE AIR TO ENGINE" TO --APPARATUS FOR CONTROLLING AMOUNT OF INTAKE AIR TO ENGINE--.

The title page should be deleted to appear as per attached title page.

The sheet of drawings containing Figs. 1-3 should be deleted to be replaced with Figs. 1-5 as shown on the attached sheet.

Signed and Sealed this

Twenty-fourth Day of April, 1990

*Attest:*

HARRY F. MANBECK, JR.

*Attesting Officer*

*Commissioner of Patents and Trademarks*

United States Patent [19]

Matsumoto

[11] Patent Number: 4,840,159

[45] Date of Patent: Jun. 20, 1989

[54] APPARATUS FROM CONTROLLING AMOUNT OF INTAKE AIR TO ENGINE

[75] Inventor: Osamu Matsumoto, Hyogo, Japan

[73] Assignee: Mitsubishi Denki Kabushiki Kaisha, Tokyo, Japan

[21] Appl. No.: 161,051

[22] Filed: Feb. 26, 1988

[30] Foreign Application Priority Data

Feb. 26, 1987 [JP] Japan ..... 62-29303
Feb. 26, 1987 [JP] Japan ..... 62-29304

[51] Int. Cl.[4] ..... F02M 23/00
[52] U.S. Cl. ..... 123/585
[58] Field of Search ..... 123/339, 585

[56] References Cited

U.S. PATENT DOCUMENTS

| | | | |
|---|---|---|---|
| 2,943,615 | 7/1960 | Kainz | 123/339 |
| 4,378,767 | 4/1983 | Kobashi et al. | 123/339 |
| 4,388,913 | 6/1983 | Grimm et al. | 123/339 |
| 4,712,531 | 12/1987 | Ishizawa et al. | 123/585 |

FOREIGN PATENT DOCUMENTS

| | | | |
|---|---|---|---|
| 59-5856 | 1/1984 | Japan . | |
| 59-18124 | 5/1984 | Japan . | |
| 62-13749 | 1/1987 | Japan | 123/339 |
| 802463 | 10/1958 | United Kingdom | 123/339 |

*Primary Examiner*—Andrew M. Dolinar
*Attorney, Agent, or Firm*—Sughrue, Mion, Zinn, Macpeak & Seas

[57] ABSTRACT

An apparatus for controlling the amount of intake air to an engine comprises a throttle body, a throttle valve disposed in the body, a bypass passage that bypasses the throttle valve. The throttle body forms a part of the air intake passage for the engine. In one embodiment of the invention, a guide passage is formed in the throttle body and extends upwardly from the bypass passage. The open end of the guide passage is disposed above the center line of the inside of the throttle body. In another embodiment of the invention, a barrier such as a protrusion or groove is formed in the inner surface of the throttle body and disposed above the open end of the bypass passage to prevent fuel, oil, and other substances from flowing into the bypass passage.

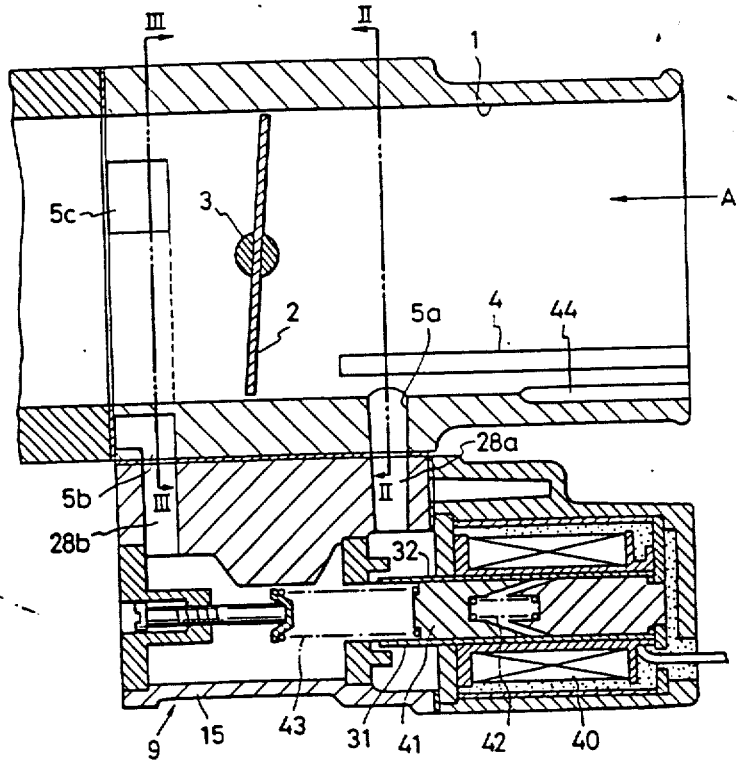

4 Claims, 3 Drawing Sheets